US005579548A

United States Patent [19]

Death

[11] Patent Number: 5,579,548

[45] Date of Patent: Dec. 3, 1996

[54] HAMMOCK HARNESSING DEVICE

[76] Inventor: S. Samuel Death, 414 Stone Rd., Unit #59, Guelph, Ontario, Canada, N1G 3E1

[21] Appl. No.: 604,535

[22] Filed: Feb. 21, 1996

[51] Int. Cl.[6] ..... A45F 3/25

[52] U.S. Cl. ..... 5/127; 5/120

[58] Field of Search ..... 182/9; 5/120, 122, 5/123, 127

[56] References Cited

U.S. PATENT DOCUMENTS

| | | | |
|---|---|---|---|
| 399,928 | 3/1889 | Pritchard . | |
| 1,721,516 | 7/1929 | Jacobs | 182/9 |
| 2,549,679 | 4/1951 | Foote | 155/78 |
| 2,847,059 | 8/1958 | Klins | 155/78 |
| 3,030,160 | 4/1962 | Tandy | 311/17 |
| 3,261,425 | 7/1966 | Harder | 182/187 |
| 3,840,091 | 10/1974 | Conlon | 182/9 |
| 3,927,733 | 12/1975 | Wurn et al. | 182/187 |
| 4,071,917 | 2/1978 | Mojica | 5/121 |
| 4,397,500 | 8/1983 | Moffitt | 297/118 |
| 4,722,421 | 2/1988 | Hilbert | 182/187 |
| 4,909,353 | 3/1990 | Govin et al. | 182/187 |
| 5,078,232 | 1/1992 | Hancosky | 182/187 |
| 5,101,934 | 4/1992 | Zumbro | 182/187 |
| 5,141,074 | 8/1992 | Sulowski et al. | 182/9 |
| 5,293,657 | 3/1994 | DeAth | 5/127 |

FOREIGN PATENT DOCUMENTS

| | | |
|---|---|---|
| 613766 | 11/1926 | France . |
| 462955 | 3/1937 | United Kingdom . |

*Primary Examiner*—Michael F. Trettel
*Attorney, Agent, or Firm*—Bereskin & Parr; Timothy J. Sinnott

[57] ABSTRACT

A device for harnessing a hammock to a tree or other load bearing member comprises a gripping belt, and spanning belt, and preferably a belt loop which helps to anchor the belts together, and a snap-hook for securing the spanning belt to the hammock. The gripping belt includes a belt buckle for releasably cinching the gripping belt around the load bearing member. The spanning belt is dimensioned for encircling the load bearing member and spanning the distance between the hammock and the load bearing member. A section of the interior portion of the spanning belt is twisted over and anchored to the gripping belt at a preselected belt intersection area, so that the free end portions of the spanning belt extend away from and below the intersection area at a preselected angle correlatable with known angles assumed by the spanning belt when hammocks are harnessed to load bearing members and placed under loads.

11 Claims, 4 Drawing Sheets

HAMMOCK HARNESSING DEVICE

FIELD OF THE INVENTION

This invention relates to devices for harnessing hammocks to trees and other load bearing members.

BACKGROUND OF THE INVENTION

In the past, hammocks have typically been suspended between two trees by ropes tied around the trees or extending from nails or hooks anchored in the trees. However, these traditional hammock suspension techniques have a number of drawbacks. Hammers or other tools are required to anchor nails or hooks into trees. This anchoring process tends to be inconvenient, slow and cumbersome. While the hammock is in use, the knots sometimes become too loose and give way under strain. Alternatively, the knots can tighten around the tree or the anchoring devices during use, making the knots difficult to untie during the take down process. These traditional techniques also often result in damage to the bark of trees. In summary, conventional techniques for setting up and taking down hammocks tend to be cumbersome, time consuming and damaging to the environment.

The hammock suspension device disclosed and claimed in the applicant's U.S. Pat. No. 5,293,657 overcomes many of the disadvantages associated with prior art suspension devices. That hammock suspension device comprises a gripping belt which is adapted to be releasably anchored around a tree, a spanning belt which is secured to the hammock by a snap-hook or other securing means, and a pair of belt loops which slideably receive both the gripping belt and the spanning belt and which releasably couples the spanning belt to the gripping belt. In use, the loops are placed on the gripping belt, and preferably positioned at the ten o'clock and two o'clock positions, as the gripping belt is cinched around the tree. The spanning belt is then threaded through the loops, and coupled to an end of the hammock. This hammock suspension device is lightweight, easy to set up, and capable of securing the hammock to a pair of variably spaced trees or other load bearing members without significant slippage or damage to the trees. However, in use, this suspension device tends to develop crimps in both of the belts at the points by which the belt loops couple the spanning belt to the gripping belt. There also exists the risk of misplacing or losing the belt loops during the setup or take down process.

SUMMARY OF THE INVENTION

The applicant has now developed an improved hammock harnessing device which possesses not only the advantages of his existing suspension device, but also some additional significant advantages.

The subject invention is a device for harnessing a hammock to a load bearing member, comprising a gripping belt dimensioned to fit around the load bearing member, having cinching means for releasably cinching the gripping belt around the load bearing member, and a spanning belt dimensioned for encircling the load bearing member and spanning the distance between the hammock and the load bearing member, having an interior portion and free end portions. A section of the interior portion of the spanning belt is twisted over and anchored to the gripping belt at a preselected belt intersection area, so that the end portions of the spanning belt extend away from and below the intersection point at a preselected angle, correlatable with known angles assumed by the spanning belt when hammocks are harnessed to load bearing members and placed under loads.

This angle is preferably selected to approximate the angle assumed by the spanning belt when a typical load is placed in the hammock and is preferably about 25 degrees. The subject hammock harness preferably includes a belt loop which loops around and is anchored to the gripping belt and the spanning belt at the intersection area. The spanning belt preferably includes coupling means for coupling together the free ends of the spanning belt, so that the spanning belt forms a closed circuit of adjustable length encircling the load bearing member.

BRIEF DESCRIPTION OF THE DRAWINGS

The invention will now be described, by way of example only, with reference to the following drawings, in which.

DETAILED DESCRIPTION OF THE PREFERRED EMBODIMENT

Figure 1:
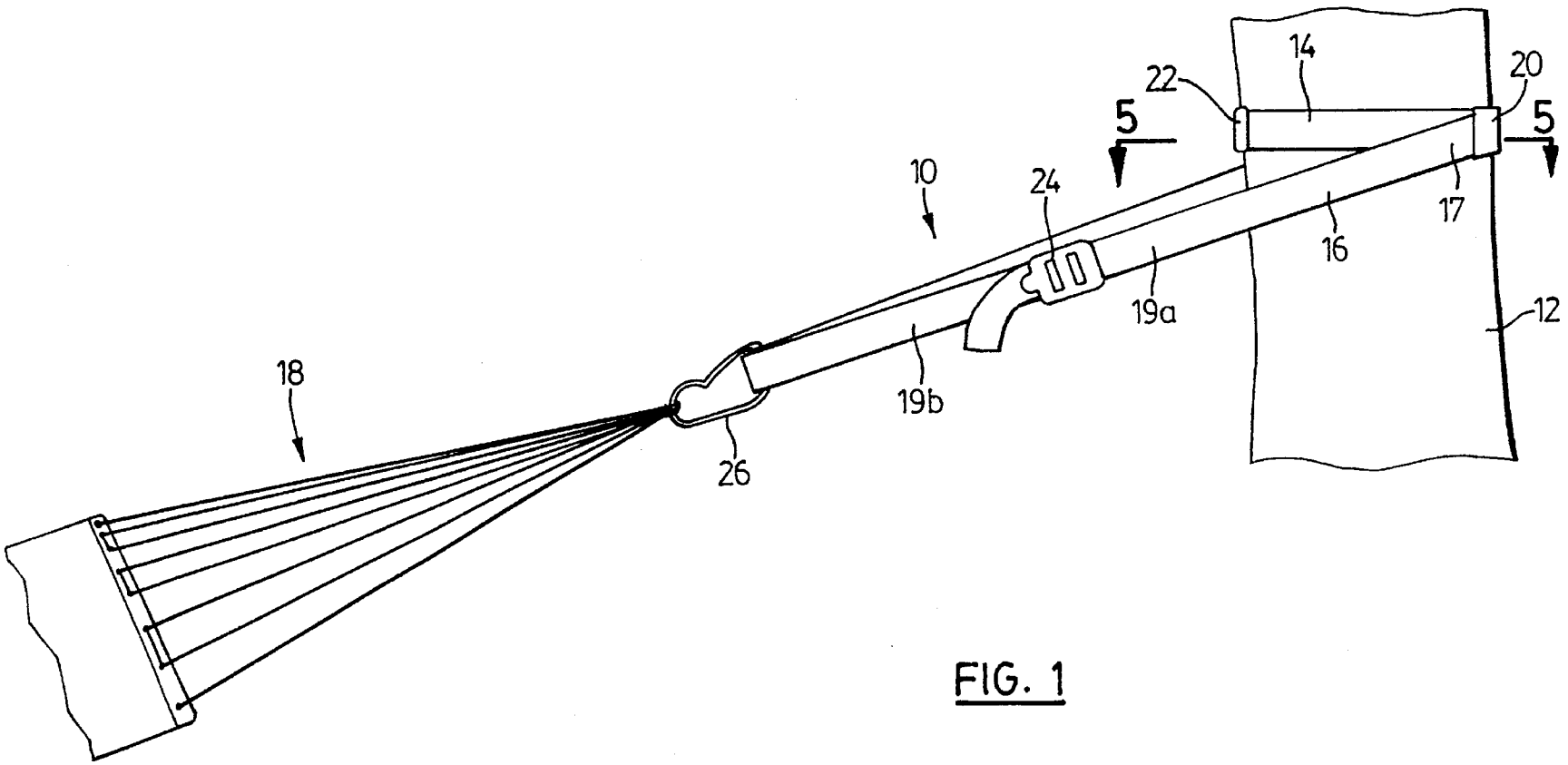
FIG. 1 is a side elevational view of a hammock harness made in accordance with a preferred embodiment of the subject invention, shown deployed on a tree coupled to a hammock.

Referring to FIG. 1, in a preferred embodiment, the subject invention is a hammock harness 10, shown deployed around tree 12. Hammock harness 10 comprises gripping belt 14 dimensioned to fit around tree 12, spanning belt 16 of sufficient length to encircle tree 12 and span the distance between tree 12 and hammock 18, and belt loop 20 which helps to anchor spanning belt 16 to gripping belt 14.

Gripping belt 14 includes slideably adjustable belt buckle 22 which enables gripping belt 14 to be releasably cinched to tree 12 or other loading bearing member. Spanning belt 16 includes an interior portion 17 and free end portions **19*a*, 19*b* which may be releasably coupled together by belt buckle 24 after spanning belt 16 is placed around tree 12. Belt buckle 24 is slideably adjustable, which enables the length of spanning belt 16 to be adjusted to span the distance between the tree 12 and hammock 18. Hammock 18 is releasably coupled to spanning belt 16 by snap hook 26** or other coupling means.

Belts 14, 16 are preferably made from one inch wide polypropylene, although other materials can be used provided that they are of sufficient strength and quality to support typical hammock loads. Belt closures 22, 24 are preferably FASTEX® or other high strength plastic adjustable webbing buckles.

Figure 2:
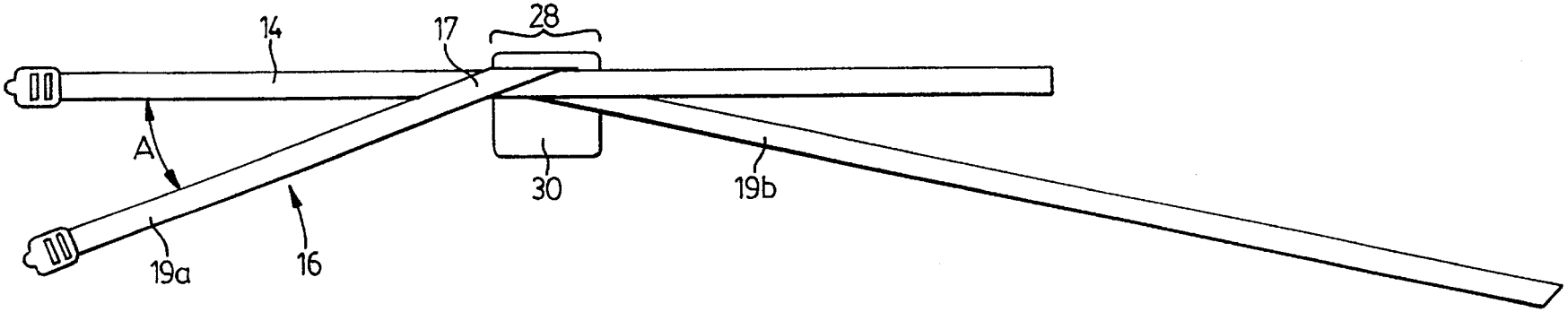
FIG. 2 is an elevational view of the components of the preferred embodiment, shown before the belt loop is stitched into place.
Figure 3:
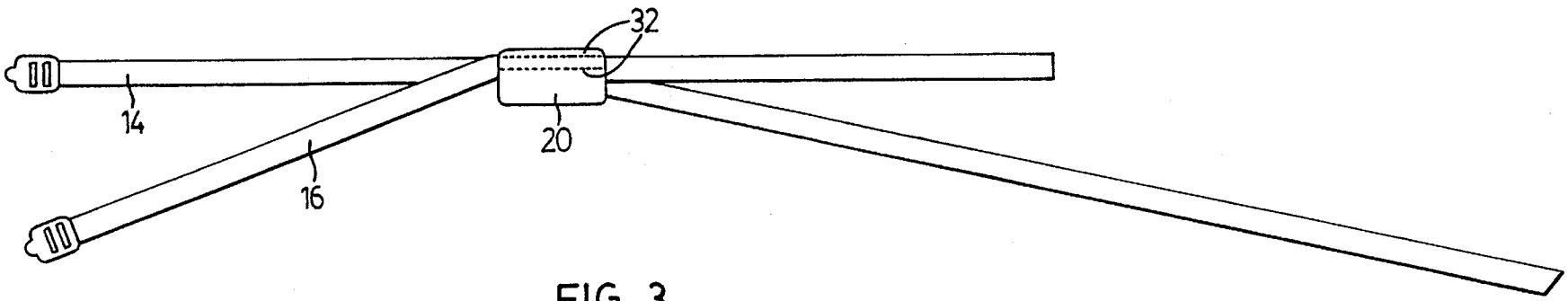
FIG. 3 is an elevational view of the components of the preferred embodiment, shown with the belt loop stitched in place.

Referring now to FIGS. 2 and 3, during the process of assembling hammock harness 10, a section of an interior portion 17 of spanning belt 16 is folded or twisted 180° over and around gripping belt 14 at a suitable belt intersection area 28, such that the free end portions **19*a*, 19*b* of spanning belt 16 extend away from and below gripping belt 14 at a selected angle A. A rectangular piece of loop material 30 is then wrapped around belts 14, 16 at belt intersection area 28, and folded over upon itself to form belt loop 20, as shown in FIG. 3. Belt loop 20 is then stitched into place, by stitching 32, which extends through both spanning belt 16 and gripping belt 14, thereby anchoring spanning belt 16 to gripping belt 14. Alternatively, belt loop 20 may be preformed, slid into place over belts 14, 16, and then stitched into place. Belt loop 30** is preferably about two inches wide and two inches long.

The angle A between gripping belt 14 and spanning belt 16 is based upon the angles assumed by spanning belt 14 during typical hammock suspension configurations. Angle A is preferably selected to be approximately the same as the angle that spanning belt 16 would assume relative to gripping belt 14 when harness 10 is deployed on tree 12 and an average load is placed in hammock 18. This construction accordingly reduces or eliminates the kinking or crimping in spanning belt 16 that would otherwise occur at belt loop 20 during use. Angle A falls within a range of about 15 degrees to about 35 degrees, and is preferably about 25 degrees.

The location of belt intersection area 28 is based upon the diameter of the recommended minimum size of a tree capable of supporting the average sized load. Preferably, intersection area 28 is located about 8–12 inches from an end of gripping belt 14.

Figure 4:
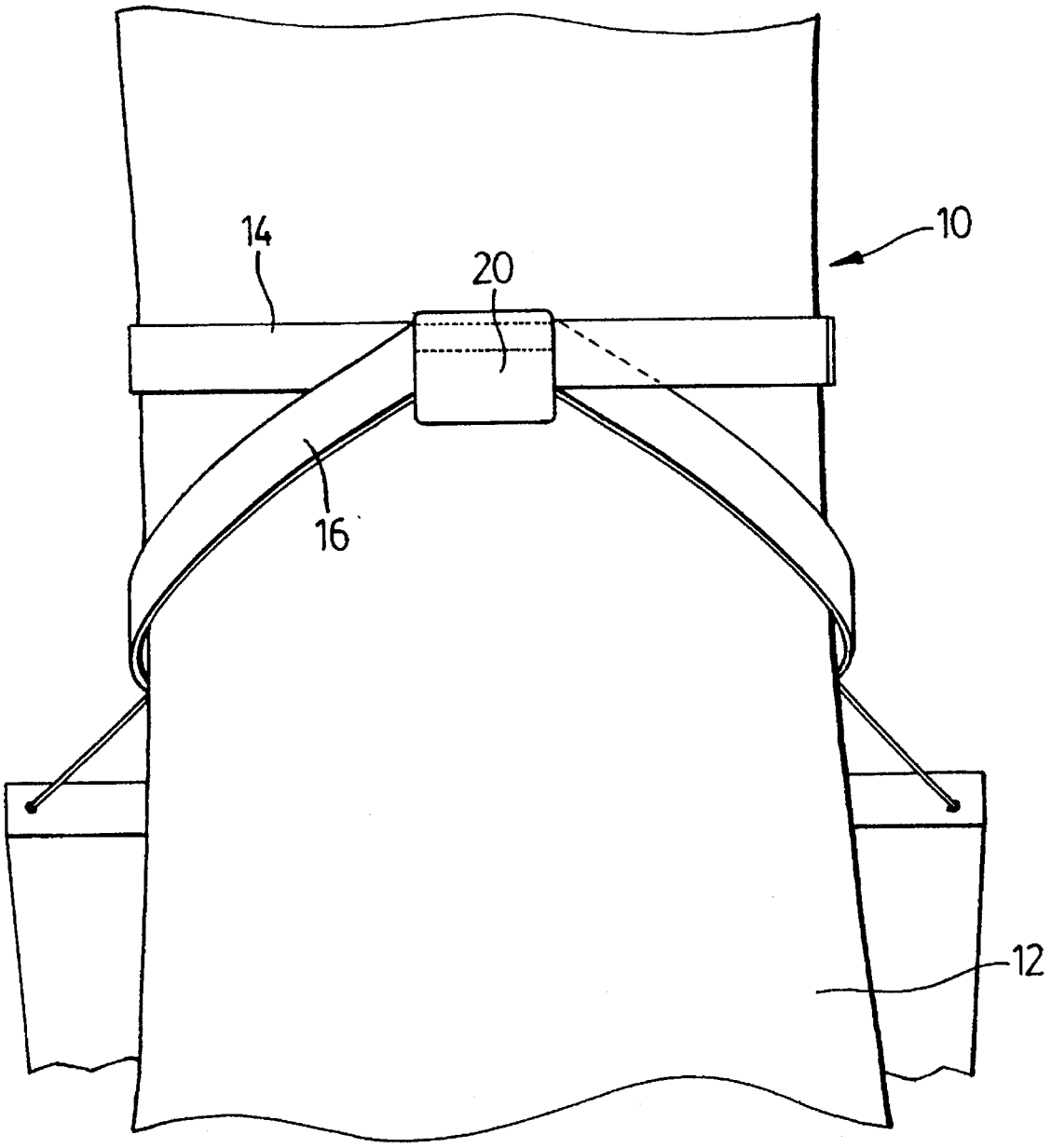
FIG. 4 is a rear elevational view of the preferred embodiment, shown deployed on a tree.
Figure 5:
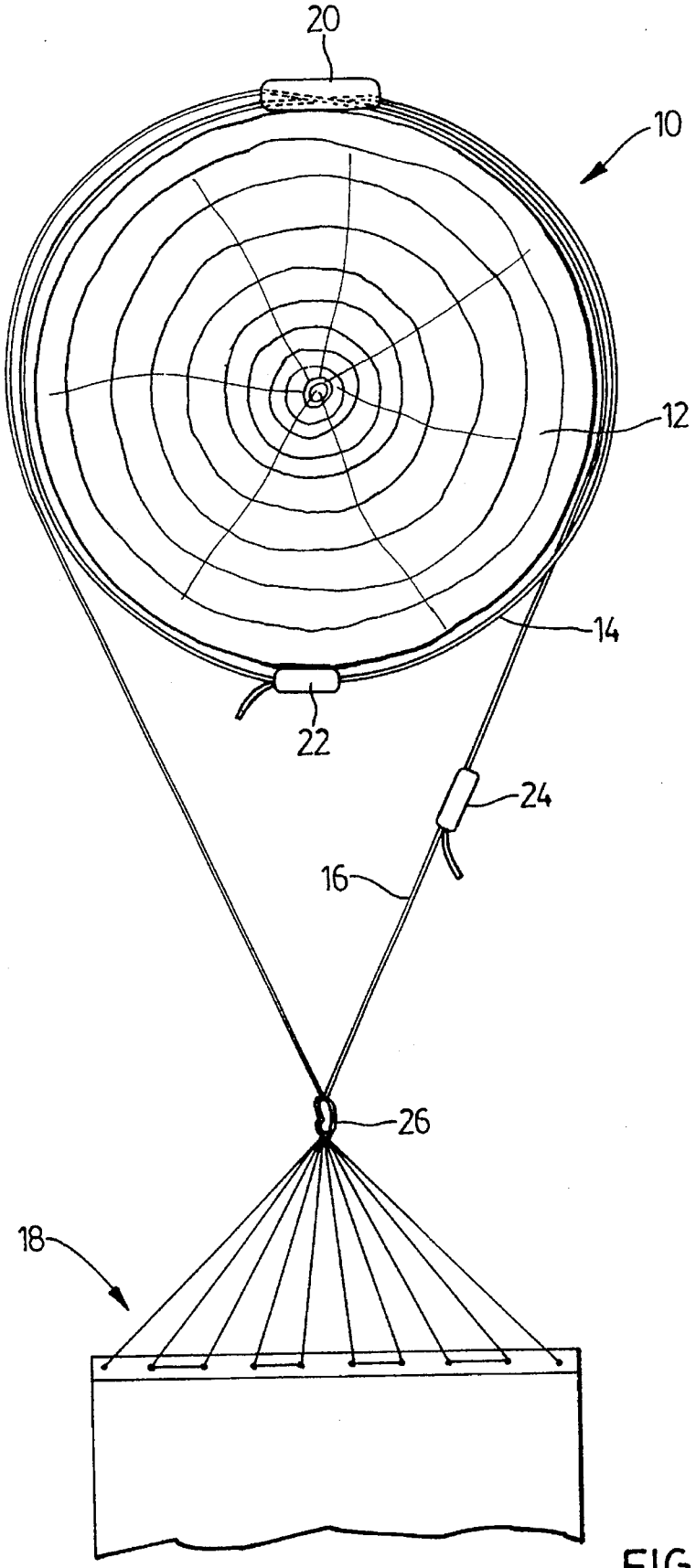
FIG. 5 is a sectional view of the preferred embodiment, taken along line 5—5 of FIG. 1.

Referring now to FIGS. 4 and 5, in use, hammock harness 10 is deployed on tree 12 by uncoupling belt closures 22, 24, and looping belts 14,16 around tree 12. Harness 10 is then rotated horizontally around tree 12 such that belt loop 20 is positioned to the rear of tree 12 at a twelve o'clock position relative to snap-hook 26 at a six o'clock position. Closure 22 of gripping belt 14 is then cinched tightly around tree 12. In the process, a portion of spanning belt 16 within belt loop 20 at intersection area 28 is sandwiched between tree 12 and gripping belt 14. The free end portions 19*a*, 19*b* of spanning belt 16 are then coupled together to form a closed circuit of suitable length, by closing coupling belt and adjusting buckle 24. Harness 10 can then be connected to hammock 18 by snap-hook 26 to spanning belt 16.

When hammock 18 is in use, the force exerted on spanning belt 16 by the hammock load is transferred onto a relatively large, torsionally stiff intersection area 28 of gripping belt 14. This construction minimizes the stresses on spanning belt 16, and reduces or eliminates kinking of spanning belt 16, because angle A approximates the actual angle assumed by spanning belt 16 while hammock 18 is in use.

It should be understood that various changes can be made to the preferred embodiment of the invention described and illustrated herein, without departing from the subject invention, the scope of which is defined in the following claims.

I claim:

1. A device for harnessing a hammock to a load bearing member, comprising:

(a) a gripping belt dimensioned to fit around the load bearing member, having cinching means for releasably cinching the gripping belt to the load bearing member; and (b) a spanning belt dimensioned for encircling the load bearing member and spanning the distance between the hammock and the load bearing member, the spanning belt comprising an interior portion and free end portions;

(c) wherein a section of the interior portion of the spanning belt is twisted over and anchored to the gripping belt at a preselected belt intersection area, so that the free end portions of the spanning belt extend away from and below the intersection area at a preselected angle correlatable with known angles assumed by the spanning belt when hammocks are harnessed to load bearing members and placed under loads.

2. The device defined in claim 1, comprising a belt loop which loops around and is anchored to the gripping belt and the spanning belt at the intersection area.

3. The device defined in claim 1, wherein the preselected angle approximates the angle assumed by the spanning belt when a typical load is placed in the hammock during use.

4. The device defined in claim 3, wherein the preselected angle falls within a range of about 15 degrees to about 35 degrees.

5. The device defined in claim 1, wherein spanning belt includes coupling means for coupling together the free ends of the spanning belt, so that the spanning belt forms a closed circuit of adjustable length encircling the load bearing member.

6. The device defined in claim 5, wherein the cinching means and coupling means comprise slideably adjustable webbing buckles.

7. The device defined in claim 2, wherein the belt loop is sewn to the gripping belt.

8. The device defined in claim 1, wherein the belt intersection area is located about 8–12 inches from an end of the gripping belt.

9. The device defined in claim 1, also comprising securing means for securing the spanning belt to the hammock.

10. The device defined claim 1, wherein the securing means comprises a snap-hook.

11. A device for harnessing a hammock to a load bearing member, comprising:

(a) a gripping belt dimensioned to fit around the load bearing member, having cinching means for releasably cinching the gripping belt to the load bearing member;

(b) a spanning belt dimensioned for spanning the distance between the hammock and the load bearing member, wherein the spanning belt comprises an interior portion and free end portions provided with closure means for selectively forming the spanning belt into a closed circuit of adjustable length encircling the loading bearing member;

(c) wherein a portion of the interior section of the spanning belt is twisted over and anchored to the gripping belt at a preselected belt intersection area, so that the free end portions of the spanning belt extend away from and below the intersection area at a preselected angle which approximates the angle assumed by the spanning belt when a typical load is placed in the hammock during use; and (d) a belt loop which loops around and is anchored to the gripping belt and the spanning belt at the intersection area.

* * * * *